US006557348B2

(12) United States Patent
Lange, Jr. et al.

(10) Patent No.: US 6,557,348 B2
(45) Date of Patent: May 6, 2003

(54) ON-LINE REMOVAL OF COPPER DEPOSITS ON STEAM TURBINE BLADES

(75) Inventors: Emery N. Lange, Jr., Texarkana, TX (US); Thomas H. Pike, Garvin, OK (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 10/067,090

(22) Filed: Feb. 4, 2002

(65) Prior Publication Data

US 2002/0190029 A1 Dec. 19, 2002

Related U.S. Application Data

(60) Provisional application No. 60/266,915, filed on Feb. 7, 2001.

(51) Int. Cl.[7] ..... F01K 13/02
(52) U.S. Cl. ..... 60/646; 60/657
(58) Field of Search ..... 60/646, 657

(56) References Cited

U.S. PATENT DOCUMENTS 4,067,690 A * 1/1978 Cuisia et al. ..... 21/2.7 R
4,350,606 A * 9/1982 Cuisia et al. ..... 252/392
4,487,745 A * 12/1984 Weiss et al. ..... 422/16

OTHER PUBLICATIONS

"Copper in the Fossil Plant Cycle" by R. B. Dooley, et al. No Date.

"Steam Turbine Efficiency and Corrosion: Effects of Surface Finish, Deposits, and Moisture" by Otakar Jonas, et al. No Date.

" Chemical Cleaning of HP Turbines at Columbia Energy Center" by G. S. Lawrence, et al. No Date.

"Steam Chemistry and its Effects on Turbine Deposits and Corrosion" by Otakar Jonas, et al. No Date.

"Financial Justification Developmental Logic for Steam Cycle Chemical Cleaning" by Steve Barber, et al. No Date.

"Copper Fouling of High–Pressure Utility Turbines: Summary of Discussion Meetings" by Andrew Howell. No Date.

* cited by examiner

*Primary Examiner*—Hoang Nguyen
(74) *Attorney, Agent, or Firm*—David L. Hedden

(57) ABSTRACT

This invention relates to an on-line process for removing copper deposits from the blades of the rotor of a steam turbine in systems, particularly condensing steam turbines. The process comprises adding an oxime to an appropriate injection point of an electric generating power plant powered by a steam turbine, where the power plant comprises a pre-boiler system, a steam generator, a steam turbine, a condenser and an electric generator.

8 Claims, No Drawings

ON-LINE REMOVAL OF COPPER DEPOSITS ON STEAM TURBINE BLADES

CROSS-REFERENCE TO RELATED APPLICATIONS AND CLAIM TO PRIORITY

Applicants hereby claim priority to U.S. provisional application Ser. No. 60/266,915 filed on Feb. 7, 2001, which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

This invention relates to an on-line process for removing copper deposits from the blades of the rotor of a steam turbine in systems, particularly condensing steam turbines. The process comprises adding an oxime to an appropriate injection point of an electric generating power plant powered by a steam turbine, where the power plant comprises a pre-boiler system, a steam generator, a steam turbine, a condenser and an electric generator.

(2) Description of the Related Art

Steam turbines are an important power source used to generate electricity. The steam turbine is part of an electric power plant that contains, among other equipment, a pre-boiler system, a steam generator, a steam turbine, a condenser, and an electric generator.

Typically, the source of the steam for the steam generator is a natural geothermal source or an artificial source generated by superheating a reservoir of water and directing it to the steam turbine. The source of heat for superheating the water is typically a fossil fuel or a nuclear reactor.

Among other components, steam turbines contain blades attached to a rotor. The force of the steam on the blades causes the rotor to rotate and drive an electric generator. Typically, many components of the steam generator and steam turbine (e.g. heat exchangers, condensers, pipes, valves, pumps, etc.) are made of an alloy of copper and nickel, mostly copper.

In addition, during the assembly of the steam system components, it is sometimes necessary to utilize materials (anti-seize compounds) designed to reduce the work required for assembly and the future disassembly of the components. High-temperature anti-seize compounds may contain copper-bearing components.

Because these components are exposed to high temperatures and pressures, and severe operating conditions, the copper volatilizes and deposits on the blades of the steam turbine as oxides of copper.

As these deposits build up on the turbine blades, the efficiency of the steam turbine decreases. (See "Utilities contend with copper to enhance cycle reliability", Straus, *Power Magazine*, January, 1992; "Copper in Fossil Plant Cycle", Dooley, EPRI, 1999; and "State of Knowledge of Copper in Fossil Plant Cycles"—EPRI, 9/97, TR-108460.) These deposits change the surface characteristics of the metal blade and decrease the operating efficiency of the steam turbine. (See "Steam Turbine Efficiency and Corrosion-Effects of Surface finish, deposits, and moisture", Jonas, et al, EPRI, Summer, 2000; "Copper Deposition and MW Loss Problem Solutions", Proceedings of the International Water Conference, 1996). The decreased in efficiency often amounts to ten to fifteen percent of the rated generator output. In order to increase the efficiency of the steam turbine, the equipment must be shut down and cleaned. (See "Chemical Cleaning of HP Turbines", Columbia Energy Center—Lawrence, IWC-95-68.) This decrease in efficiency results in lost revenue and increased expenditures.

It is known to use methyl ethyl ketoxime (MEKO) as an oxygen scavenger and metal passivator in boilers. See, for instance, U.S. Pat. No. 4,487,745. This patent indicates that the amount of oxime used in treating boiler water is from 0.0001 ppm to 500 ppm, although commercial utility plant experience indicates that the typical dosage of MEKO used to control feedwater oxygen scavenging is from 30–80 ppb. MEKO controls corrosion in the feedwater circuit by scavenging oxygen and by establishing a corrosion-resistant oxide film on waterside metallic surfaces.

All citations referred to under this description of the "Related Art" and in the "Detailed Description of the Invention" are expressly incorporated by reference.

BRIEF SUMMARY OF THE INVENTION

This invention relates to an on-line process for removing copper deposits from the blades attached to the rotor of steam turbine wherein said process comprises:

adding an effective copper deposit-removing amount of an oxime to an injection point of an electric generating power plant comprising a pre-boiler system, a steam generator, a steam turbine, a condenser, and an electric generator, such that the system contains a source of copper, and such that the oxime reaches a temperature of at least 30° C. and contacts the blades attached to the rotor of the steam turbine.

The source of copper usually is from one or more components comprised of alloys containing copper and/or additives comprised of a copper and/or or anti-seize additives. The injection of the oxime is effective in reducing or removing the copper deposits from the turbine blades. Consequently, the steam turbine operates more efficiently, and shut downs are reduced or eliminated.

BRIEF DESCRIPTION OF THE SEVERAL VIEWS OF THE DRAWINGS

Not Applicable.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All units are in the metric system and all percentages are percentages by weight unless otherwise specified.

An electric power plant powered by a steam turbine typically comprises (1) a pre-boiler/feedwater facility, (2) a steam generator, (2) a steam turbine, (3) an electric generator, (4) valves, (5) pumps, and (6) possibly a condenser, evaporator, and/or deaerator, as well as other components.

A pre-boiler system can be composed of one or more low pressure feedwater heaters, a deaerating heater, boiler feed pumps, one or more high pressure feedwater heaters, and an economizer. All pre-boiler system components except for the boiler feed pumps are designed to heat the water prior to the boiler. This reduces the amount of fuel required to convert the water to steam in the steam generator.

The steam generator is the source of steam. The source of the steam may be natural occurring geothermal steam, or steam produced by superheating water by means of a fossil fuel or a nuclear reactor.

A steam turbine comprises (1) a rotor, or series of rotors on a shaft, with blades attached to the rotor(s), (2) a casing for the rotor that serves as a pressure vessel for containing the steam and accommodates fixed nozzles through which the steam is accelerated before being directed against the blades attached to the rotor, (3) a mechanism to regulate the speed of the rotor, and (4) a support system for the bearings that support the rotor. The rotor of the steam turbine turns as steam impinges against blades attached to the rotor. When the rotor is turned, it turns the electromagnet of an electric generator, which produces electricity.

In a typical steam turbine system, water is converted to steam by a steam generator and transported to one or a plurality of turbines, e.g. a high pressure a (HP) turbine, an intermediate pressure (IP) turbine, and a low pressure (LP) turbine, all coupled to a common shaft to drive an electrical generator. Steam generated from the steam generator is directed through the HP, IP, and LP turbines through a main steam line via main steam valves and a control valves. As the steam passes through one or the plurality of turbines, pressure and temperature changes occur. At or near the exit of the low-pressure turbine, the steam undergoes an expansion and is moisturized. The moisturized steam exiting from the low-pressure turbine transported to a condenser, where it is condensed and eventually returned to the boiler of the steam generator.

If high-pressure, high-temperature steam is partially expanded through a turbine, the efficiency can be increased by returning the steam to the steam generator and re-heating it to approximately its original temperature before feeding it back to the turbine. Single reheat turbines are commonly used in the electric utility industry. For very large units, double re-heating may be employed. Non-reheating turbines are currently limited mostly to industrial plants and small utilities.

As was mentioned previously, a steam turbine often is connected to a condenser. A condensing steam turbine condenses the steam below atmospheric pressure to gain the maximum amount of energy from the steam. In non-condensing turbines, steam leaves the turbine above atmospheric pressure and is then used for heating or for other processes before returning as water to the boiler.

The efficiency of a steam turbine is typically measured by its "heat rate", which is the amount of heat that has to be supplied to the feedwater in order to produce a specified generator power output. The heat rate is the heat input in BTUs per hour for each kilowatt-hour of electricity produced. Among other factors, the heat rate depends upon the amount of copper deposit built up on the turbine blades of the steam turbine. The lower the heat rate, the less the thermal energy required and the better the efficiency.

Turbine efficiency is calculated by comparing the actual versus theoretical steam flow rates, the actual versus theoretical steam temperatures, and the actual versus theoretical electric energy produced.

The oximes used in this process are described in U.S. Pat. No. 4,487,745 which is hereby incorporated by reference and shown by the following chemical structure:

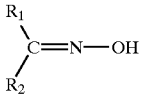

wherein $R_1$ and $R_2$ are the same or different and are selected from hydrogen, lower alkyl groups of 1–8 carbon atoms and aryl groups, and mixtures thereof, particularly aliphatic oximes. Most preferably used, as the oxime, is methyl ethyl ketoxime (MEKO).

The oxime is fed into the electric generating power plant at any injection point where the oxime is activated and the steam will come into contact with the turbine blades. In order to activate the oxime, the oxime is added to an injection point that exposes the said methyl ethyl ketoxime to a temperature of about 30° C. to about 320° C. The oxime is injected at a point in the system, so that the oxime will eventually contact the blades of the rotor of the steam turbine.

Examples of such injection points for the oxime include the pre-boiler system of the steam generator, the boiler steam drum of the steam generator, the feedwater of the lower pressure steam turbine, the highest-temperature feedwater heater extraction steam of the lower pressure steam turbine, the main steam header prior to the turbine, and the turbine crossover piping.

Preferably the oxime is fed into the highest-temperature feedwater heater extraction steam of the lower pressure steam turbine and/or the boiler steam drum of the steam generator. This will not only improve operating efficiency, but also maintains cleanliness, while minimizing the potential for damage to the system components. The addition of MEKO to these injection points, in an amount sufficient to obtain a residual of at least 5 ppb in the steam exiting the steam drum, will result in increased operating efficiency of the steam turbine. Although it is preferable to add the oxime to an injection point already existing in the electric generating power plant, it is possible to create special valves or openings that serve as an injection point for the oxime.

The typical dosage of oxime used to reduce copper deposits on steam turbine blades is at least 1 ppb, preferably at least 5 ppb, and most preferably, at least 50 ppb. However, the oxime dosage, in most cases, is not expected to exceed 250 ppb. Preferably, the oxime is fed continuously, and the dosage is typically maintained for a minimum of 1 week, preferably from 2 to 4 weeks. Typically, the feed time for the oxime does exceed 12 weeks. The oxime is typically injected at a pressure of approximately 50 to 3500 psig at the injection point.

The operating efficiency of the high-pressure turbine, intermediate-pressure turbine, and low-pressure turbine increases by the addition of the oxime.

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application, all units are in the metric system and all amounts and percentages are by weight, unless otherwise expressly indicated.

Example 1

MEKO is Fed to the Highest-Temperature, Low-Pressure Turbine Feedwater Heater Extraction Steam of the Steam Turbine and the Steam Drum of the Steam Generator The steam turbine used is a two-cylinder, tandem compound double exhaust, condensing reheat turbine. The steam contains a high pressure (HP) steam turbine, an intermediate pressure (IP) steam turbine, a low pressure (LP) steam turbine. The HP-IP turbines are a combined impulse and reaction type. Steam flows from the HP steam turbine to the IP steam turbine and then to the LP steam turbine. Steam enters the turbine initially through the throttle valves of the turbines and then flows to the governor valves of the turbines. The governor valves control the flow of steam into the turbine cylinders by way of steam inlet pipes.

The steam generator is composed of a steam drum, four panels of waterwall furnace generating tubes, a lower waterwall distribution header, and downcomer headers. Water enters the steam drum, travels downward through the downcomer headers and is distributed to the waterwall furnace generating tubes by the lower waterwall distribution header. As heat is applied to the waterwall furnace generating tubes, steam bubbles are generated. Since steam bubbles are less dense than the water, the steam/water mixture rises to the steam drum, where the steam is released and the remaining water enters the downcomer headers, beginning the process again.

The efficiencies of the HP, IP, and LP turbines were measured over a 19 day period prior to the addition of the MEKO. Turbine efficiency calculations were performed by measuring actual versus theoretical steam flow rates, actual versus theoretical steam temperatures, and actual electric generation.

Following the previous off-line turbine cleaning, the efficiencies of the high pressure, intermediate pressure, and low pressure turbines were monitored. In addition, the electric generator output was monitored. It was determined that within two weeks of operation, the electric generation capacity was reduced.

Samples of turbine blade deposits collected during the shutdown, prior to the off-line turbine cleaning, indicated the presence of copper oxides.

Beginning on the nineteenth day, MEKO was fed into the highest-temperature, low-pressure turbine feedwater heater extraction steam of the steam turbine and into the boiler steam drum of the steam generator at a dosage of about 50 ppb. The efficiency of the steam turbine before feeding MEKO and after is summarized in Table I.

TABLE I

| | % Efficiency | | |
|---|---|---|---|
| Day | HP | IP | LP |
| 1 | 85.16 | 88.99 | 98.15 |
| 15 | 85.53 | 89.08 | 97.5 |
| 19 | 85.82 | 88.13 | 95.77 |
| 34 | 86.15 | 89.28 | 95.97 |
| 48 | 88.36 | 89.25 | 97.79 |

The data in Table I indicate that the efficiency of the HP, IP, and LP turbines improved during the 30 days the MEKO was fed into the highest-temperature, low-pressure turbine feedwater heater extraction steam of the steam turbine and the boiler steam drum of the steam generator.

What is claimed is:

1. An on-line process for removing copper deposits from the blades attached to the rotor of steam turbine wherein said process comprises:

adding an effective copper deposit-removing amount of an oxime to an injection point of an electric generating power plant comprising a pre-boiler system, a steam generator, a steam turbine, a condenser, and an electric generator, such that the system contains a source of copper, and such that the oxime reaches a temperature of at least 30° C. and contacts the blades attached to the rotor of the steam turbine.

2. The process of claim 1 wherein the oxime is methyl ethyl ketoxime.

3. The process of claim 2 wherein the source of copper is from one or more components of the one or more of the components of the steam generator made of alloys of copper.

4. The process of claim 3 wherein the dosage of oxime injected into the power plant is from 50 ppb to 150 ppb.

5. The process of claim 4 wherein the injection point of the oxime is selected from the group consisting of the feedwater of the lower pressure steam turbine and the boiler steam drum of the steam generator.

6. The process of claim 5 wherein the steam turbine contains a high-pressure turbine, an intermediate pressure turbine, and a low-pressure turbine.

7. The process of claim 6 wherein the oxime is continuously fed to the injection point for a period of 1 to 4 weeks.

8. The process of claim 7 wherein the steam turbine is a condensing steam turbine.

* * * * *